US006791497B2

(12) United States Patent
Winebrand et al.

(10) Patent No.: US 6,791,497 B2
(45) Date of Patent: Sep. 14, 2004

(54) SLOT SPIRAL MINIATURIZED ANTENNA

(75) Inventors: Mark Winebrand, Netanya (IL); Vladimir Rojanski, Or Akiva (IL)

(73) Assignee: Israel Aircraft Industries Ltd., Ben Gurion International Airport ( * ) Notice: Subject to any disclaimer, the term of this patent is extended or adjusted under 35 U.S.C. 154(b) by 0 days.

(21) Appl. No.: 09/963,061

(22) Filed: Sep. 25, 2001

(65) Prior Publication Data

US 2002/0122009 A1 Sep. 5, 2002

Related U.S. Application Data

(60) Provisional application No. 60/236,819, filed on Oct. 2, 2000.

(51) Int. Cl.[7] ..... H01Q 1/24; H01Q 1/36; H01Q 13/10

(52) U.S. Cl. ..... 343/702; 343/767; 343/895

(58) Field of Search ..... 343/767, 895, 343/702

(56) References Cited

U.S. PATENT DOCUMENTS

| | | | | | |
|---|---|---|---|---|---|
| 3,034,121 | A | * | 5/1962 | Riblet | 343/770 |
| 3,465,346 | A | | 9/1969 | Patterson | 343/895 |
| 3,781,898 | A | | 12/1973 | Holloway | 343/872 |
| 3,969,732 | A | | 7/1976 | Holloway | 343/895 |
| 4,297,707 | A | * | 10/1981 | Brunner et al. | 343/725 |
| 5,815,122 | A | | 9/1998 | Nurnberger et al. | 343/767 |
| 5,955,997 | A | * | 9/1999 | Ho et al. | 343/767 |
| 6,023,250 | A | | 2/2000 | Cronyn | 343/895 |
| 6,160,523 | A | * | 12/2000 | Ho | 343/770 |

OTHER PUBLICATIONS

Morgan, "Reduced size spiral antenna," Proc. 9th European Microwave Conference, Sep., 1979, pp. 181–185.

Nurnberger, M. W. et al., "A New Planar Feed for Slot Spiral Antennas", IEEE Transactions on Antennas and Propagation, Jan. 1996, pp. 130–131, vol. 44, No. 1, IEEE, New York, NY, USA.

Nurnberger, M. W. et al., "A Planar Slot Spiral For Multi–Function Communications Apertures", Antennas and Propagation Society International Symposium, Jun. 1998, pp. 774–777, IEEE, New York, NY, USA.

Hofer, Dean A. et al., "A Low–Profile, Broadband Balun Feed", Antennas and Propagation Society International Symposium, Jun. 1993, pp. 458–461, AP–S, IEEE, New York, NY, USA.

Ozdemir, T. et al., "Analysis of Thin Multioctave Cavity–Backed Slot Spiral Antennas", IEE Proceedings; Microwaves, Antennas and Propagation, Dec., 1999, pp 447–454, vol. 146, No. 6, IEE, Stevenage, Herts, GB.

* cited by examiner

*Primary Examiner*—Michael C. Wimer
(74) *Attorney, Agent, or Firm*—Fitch, Even, Tabin & Flannery

(57) ABSTRACT

A slot spiral miniaturized antenna is described. The antenna includes a conductive layer formed on a first side of a dielectric substrate. A slot arranged in the form of a spiral curve and having a slow-wave structure is formed in the conductive layer. The antenna also includes a planar balun formed on a second side of the substrate. The balun is in the form of a conductive layer strip positioned beneath a section on the conductive layer defined by an area between two neighboring parts of the slotline. The conductive layer strip has a shape that replicates a pattern of the two neighboring parts of the slotline. The conductive layer strip provides a balanced feed to the slot at a feedpoint that is defined by a place wherein a projection of said conductive layer strip on the second side intercepts the slotline. Electromagnetic coupling between the conductive layer strip and the slotline without electrical contact causes the exciting of the slotline. The antenna of the present invention is geometrically smaller than another antenna performing the same functions, but without such features as the slow-wave structure of the slotline and the replication of a pattern of the slotline shape by a conductive layer strip.

70 Claims, 7 Drawing Sheets

| Conventional Zigzag Configuration | Slow-wave factor Eq.(1) | Modified Zigzag Configuration | Slow-wave factor Eq.(3) |
|---|---|---|---|
| 4 / 2 | 0.45 | 4 / 2 | 0.335 |
| 3.5 / 2 | 0.5 | 3.5 / 2 | 0.366 |
| 3 / 2 | 0.55 | 3 / 2 | 0.4 |
| 2.5 / 2 | 0.62 | 2.5 / 2 | 0.44 |
| 2 / 2 | 0.71 | 2 / 2 | 0.5 |
| 1.5 / 2 | 0.8 | 1.5 / 2 | 0.57 |
| 1 / 2 | 0.89 | 1 / 2 | 0.66 |
| 0.5 / 2 | 0.97 | 0.5 / 2 | 0.8 |

FIG. 5

SLOT SPIRAL MINIATURIZED ANTENNA

This application claims the benefit of U.S. Provisional Application No. 60/236,819, filed Oct. 2, 2000.

FIELD OF THE INVENTION

The present invention relates generally to antennas, and in particular, to slot spiral, miniature antennas.

BACKGROUND OF THE INVENTION

Spiral antennas are well known in the art as means of providing circularly polarized radiation over a broad frequency band. The most popular configurations are the dual arm equiangular. Archimedean and logarithmic spirals, in which the two arms are fed in antiphase at the center (see, for example, U.S. Pat. Nos. 3,781,898 and 3,969,732 both) to Holloway). The lowest frequency of operation in such antennas is determined by the diameter of the spiral, where the outer circumference is equal to the longest wavelength.

There are many applications in which the small size of the antennas is a desirable feature due to cosmetic, security, aerodynamic and other reasons. There are also applications in which surface conformability of the antennas or a possibility to mount an antenna on a platform, which is not flat or planar, is a desirable feature.

For example, in mobile devices (e.g., cellular phones, PDAs, laptops, etc), reducing antenna's size is required since the amount of space available for mounting an antenna is limited. For antennas mounted on airplanes, the protrusion of the antenna beyond the surface of the plane should be minimized in order to reduce the effect of the antenna on its aerodynamic properties.

Generally, a decrease in the size of the spiral antenna may be accomplished by the reduction of its aperture and/or thickness.

Various approaches are known in the art for gaining an aperture reduction of the antennas. For instance, the aperture reduction may be achieved by utilization of perimeter squared spiral configurations. Further aperture reduction may also be accomplished by utilizing a square spiral with a zigzag track to produce a slow wave structure (see, for example, U.S. Pat. No. 3,465,346 to Patterson and "Reduced size spiral antenna", Proc. 9-th European Microwave Conf., September. 1979, pages 181–185, by Morgan).

The slow-wave structure features a slower phase velocity and, consequently, a smaller radiation zone at the lowest operating frequency that, in turn, allows the diameter of the slow-wave antenna to be reduced significantly. The reduction in size is proportional to the degree of slowing of the slow-wave, as measured by the slow-wave factor, which is defined as the ratio of the phase a velocity of the propagating wave in the traveling wave structure to the speed of light in a vacuum.

Various approaches for aperture reduction were implemented by implementation of multi-arms antennas. For example, U.S. Pat. No. 6,023,250 to Cronyn discloses an antenna having a plurality of exponential-spiral shaped antenna arms in which each of the arms includes an antenna clement having a sinuous portion.

Since a spiral in the antennas radiates bidirectionally, backed metallic and absorbing cavities are generally used (see, for example, Morgan, "Reduced size spiral antenna", Proc. 9-th European Microwave Conf., September. 1979, pages 181–185). The backed cavity is employed to redirect half of the energy constructively to form a main beam. Theoretically, the optimum cavity depth is a quarter of the wavelength $\lambda$. If the frequency approaches the value $\lambda/2$, then the reflected energy is in antiphase with the forward radiation, that results in beam splitting and a degraded match. Therefore, many conventional spiral antennas employ absorbing cavities that absorb the energy within the cavity, thereby preventing it from reflecting destructively and providing broadband operation. Despite the technical advantages, adding a cavity to the spiral antenna may significantly increase its thickness to the overall antenna structure, that contradicts the small size requirements.

A slot spiral antenna with an integrated planar balun and feed is described in U.S. Pat. No. 5,815,122 to Numberger, et al. The slot spiral antenna is produced by using standard printed circuit techniques. A conducting layer of the material substrate is etched to form a radiating spiral slot. The balun structure includes a microstrip line that winds toward the center of the slot spiral. At the center of the slot spiral, the feed is executed by breaking the ground plane of the microstrip line with the spiral slot. The technique disclosed in U.S. Pat. No. 5,815,122 substantially reduces the size of the conventional spiral antennas, such that the antenna may be suitable for incorporating into the skin of some mobile devisees. However, the diameter of this antenna is still big in order to fit the external surface of a mobile phone.

Thus, there is still a need for further improvement in order to provide an antenna that might include the broad band performance, surface conformability, uni-directionality and reduced aperture and thickness (e.g.. suitable for flush mounting with the external surface of a mobile phone), all the features in a single package.

SUMMARY OF THE INVENTION

The present invention satisfies the aforementioned need by providing a slot spiral antenna that is geometrically smaller than another antenna performing the same functions.

The antenna includes a conductive layer formed on a first side of a dielectric substrate. A slot arranged along a spiral curve is formed in the conductive layer by using conventional printed circuit techniques. A slotline of the slot has a slow-wave structure, e.g. zigzag, meander line, sine, fractal, etc.

The antenna also includes a planar balun formed on a second side of the substrate. The balun is in the form of a conductive layer strip positioned beneath a section on the conductive layer defined by an area between two neighboring parts of the slotline. The conductive layer strip bas a shape that replicates a pattern of the two neighboring parts of the slotline. For example, when a slotline of the slot has a zigzag shape, the shape of the conductive layer strip may resemble a sine pattern.

The conductive layer strip provides a balanced feed to the slot at a feedpoint that is defined by a place wherein a projection of said conductive layer strip on the second side intercepts the slotline. Electromagnetic coupling between the conductive layer strip and the slotline without electrical contact causes the exciting of the slotline.

In order to limit the radiation to one direction, a thin cavity may be included. The cavity may face either the first or second side of the substrate. The cavity may be filled with high dielectric loss material, low dielectric loss material or a combination thereof.

If it is necessary to decrease the coupling between the slotline and the conductive layer strip, then the antenna may include vias made near singularity points of the slow wave structure, e.g., near zigzag vertexes.

According to one embodiment of the present invention, in vertexes of the zigzag, an angle of the teeth may have a magnitude of about zero degrees.

The antenna of the present invention is geometrically smaller than another antenna performing the same functions, but without such features as the slow-wave structure of the slotline and the replication of a pattern of the slotline shape by a conductive layer strip.

The antenna of the present invention has many of the advantages of the prior art techniques, while simultaneously overcoming some of the disadvantages normally associated therewith.

The antenna according to the present invention may be mounted flush with the surface of a mounting platform.

The antenna according to the present invention may be relatively thin in order to be inset in the skin of a mounting platform without creating a deep cavity therein.

The antenna according to the present invention may be readily conformed to complexly shaped surfaces and contours of a mounting platform.

The antenna according to the present invention may be easily and efficiently manufactured.

The antenna according to the present invention is of durable and reliable construction.

The antenna according to the present invention may have a low manufacturing cost.

In summary, according to one broad aspect of the present invention, there is provided a slot spiral antenna comprising:

a dielectric substrate of a predetermined form having a first surface and a second surface, a conductive layer on said first side of the substrate said conductive layer including at least one slot defined by a slotline arranged in the form of a spiral curve, at least a portion of the slotline having a pattern corresponding to a slow-wave structure;

a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact.

According to another broad aspect of the present invention there is provided a a slot spiral antenna comprising:

a dielectric substrate of a predetermined form having a first surface and a second surface, a conductive layer on said first side of the substrate, said conductive layer including at least one slot defined by a slotline arranged in the form of a spiral curve, at least a portion of the slotline having a pattern corresponding to a slow-wave structure;

a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact, wherein said antenna being fitted for use in a hand-held communication device.

According to yet another broad aspect of the present invention, there is provided a slot spiral antenna comprising:

a dielectric substrate of a predetermined form having a first surface and a second surface, a conductive layer on said fast side of the substrate, said conductive layer including at least one slot defined by a slotline arranged in the forms of a spiral curve, at least a portion of the slotline having a pattern corresponding to a slow-wave structure;

a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact, wherein said antenna being automatically configured to operate over at least one octave frequency band.

According to still another broad aspect of the present invention, there is provided a hand-held communication device comprising an antenna comprising:

a dielectric substrate of a predetermined form having a first surface and a second surface, a conductive layer on said first side of the substrate, said conductive layer including at least one slot defined by a slotline arranged in the form of a spiral curve, at least a portion of the slotline having a pattern corresponding to a slow-wave structure;

a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact.

According to yet another broad aspect of the present invention, there is provided a hand-held communication device comprising a slot spiral antenna including a balun, wherein the antenna is adapted to provide a mutual operation of least three communication services operating in non-overlapping frequency bands.

According to yet another broad aspect of the present invention, there is provided a hand-held communication device comprising a slot spiral antenna including a balun, wherein said antenna being automatically configured to operate over at least one octave frequency band within the frequency range of about 800 MHz to 3 GHz.

According to yet another broad aspect of the present invention, there is provided a method for fabricating a slot spiral antenna comprising:

providing a dielectric substrate of a predetermined form having a first surface and a second surface;

forming a conductive layer on said first side of the substrate, said conductive layer including at least one slot defined by a slotline arranged in the form of a spiral curve, at least a portion of the slotline having a pattern corresponding to a slow-wave structure;

forming a planar balun on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact.

According to still another broad aspect of the present invention, there is provided a conductive layer antenna comprising a dielectric substrate of a predetermined form having a microstrip on one side of the substrate arranged in the form of a spiral curve, at least a portion of the microstrip having a pattern of zigzag; the zigzag having a reversed S-type shape.

There has thus been outlined, rather broadly, the more important features of the invention so that the detailed description thereof that follows hereinafter may be better understood, and the present contribution to the art may be better appreciated. Additional details and advantages of the invention will be set fort in the detailed description.

BRIEF DESCRIPTION OF THE DRAWINGS

In order to understand the invention and to see how it may be carried out in practice, a preferred embodiment will now be described, by way of non-limiting example only, with reference to the accompanying drawings, in which:

FIG. 5 is a table illustrating the values of slow-wave factor for the conventional zigzag and the corresponding values of slow-wave factor for the modified zigzags, according to one embodiment of the present invention;

DETAILED DESCRIPTION OF SPECIFIC EMBODIMENTS

The principles and operation of a slot spiral antenna according to the present invention may be better understood with reference to the drawings and the accompanying description. It being understood that these drawings are given for illustrative purposes only and are not meant to be limiting.

Figure 1:
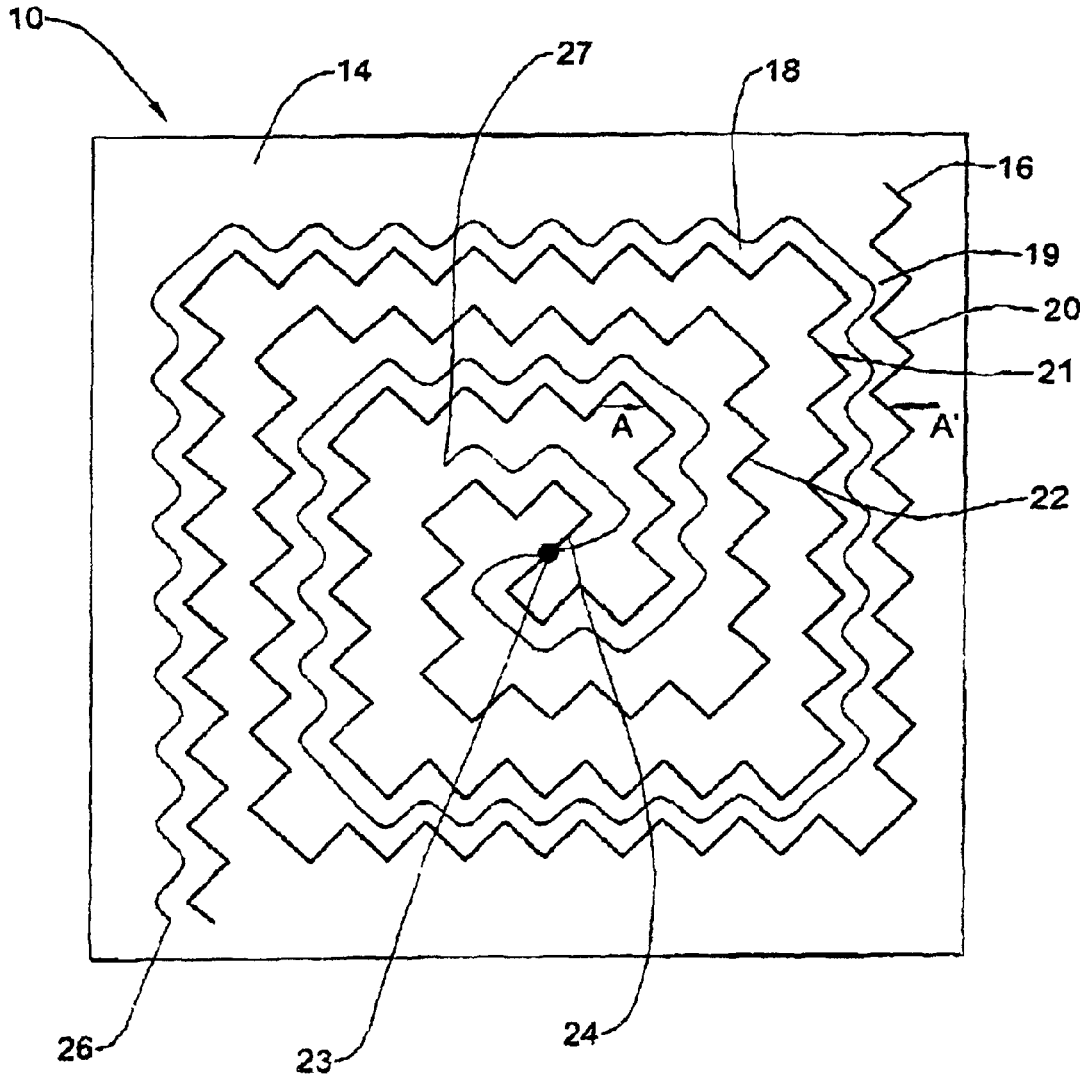
FIG. 1 is a schematic view of the slot spiral antenna and balun according to one embodiment of the present invention.
Figure 2:
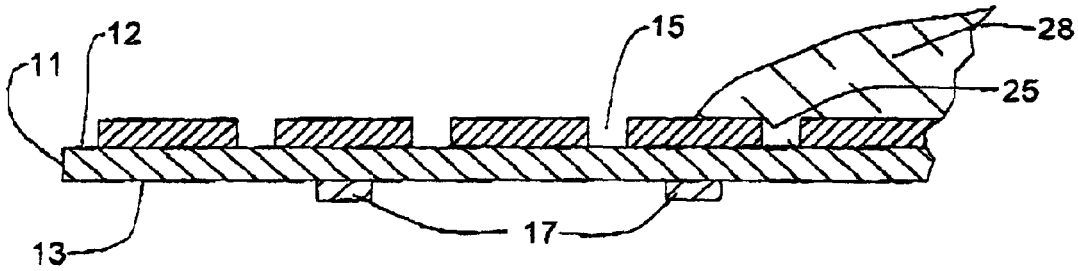
FIG. 2 is a schematic view of a cross-section of a portion of the antenna, according to one embodiment of the present invention taken along A–A' in FIG. 1.

Referring now to the drawings wherein like reference numerals designate corresponding parts throughout the several views, FIG. 1 and FIG. 2 illustrate a schematic view of the slot spiral antenna 10 according to one embodiment of the present invention.

The antenna 10 includes a dielectric substrate 11 having a first surface 12 and a second surface 13. The first surface 12 is covered by a conductive layer 14. A portion of the conductive layer 14 is removed to produce a slot 15 defined by a slotline 16 having a pattern corresponding to a slow-wave structure, e.g., zigzag, meander line, sine, fractal, etc. The slotline 16 is arranged in the form of a spiral curve to form a two arm slotted spiral. It should be appreciated that the spiral curve of the slotline 16 may be in any form, e.g., rectangular, Archimedean, logarithmic, etc. It should be appreciated that the slotline 16 may also have an acentric and non-symmetric form that is a combination of various forms. The spiral may be of any size, have any number and density of turns and growth rates. The density of the turns may be non-uniform, i.e. may depend on the spiral rotation angle and a location of a feed point 23.

The second surface 13 is also covered by a conductive layer (not shown). A portion of the layer is removed to produce a planar "infinite" balun 17. The procedures used to remove the portions of the conducting layers on the first and second surfaces may be any one of the common techniques used to produce printed circuit boards such as etching, milling or other standard printed circuit techniques.

The balun 17 is in the form of a conductive layer strip 18 positioned beneath a section 19 on the conductive layer defined by an area between two neighboring parts 20 and 21 of the slotline 16. Preferably, but not mandatory, that the width of the conductive layer strip 18 between strip ends 26 and 27 be at least three times narrower than the width of the section 19. In order to improve the ratio between these widths, the distance between the two neighboring parts 20 and 21 (encompassing the conductive layer strip 18) may be made wider than the distance between the next two neighboring parts, such as 21 and 22, which do not encompass the conductive layer strip 18.

The conductive layer strip 18 has a shape that substantially replicates a pattern of the two neighboring parts 20 and 21 of the slotline 16. According to one non-limiting example, when a slotline of the slot has zigzag shape, the shape of the conductive layer strip may resemble a sine pattern.

The conductive layer 14 acts as a ground plane for the conductive layer strip 18. As shown in FIG. 1, the conductive layer strip 18 is wound toward the feedpoint 23 and provides a balanced feed to the slot at the feedpoint 23 that is defined by the place wherein the projection of said conductive layer strip 18 on the second side intercepts the slotline 16.

According to one embodiment of the present invention, the feedpoint 23 is arranged at a center of an aperture of the antenna.

According to another embodiment of the present invention, the feedpoint 23 is arranged at any place of an aperture of the antenna.

Electromagnetic coupling between the conductive layer strip 18 and the slotline 16 at the feedpoint 23 without electrical contact causes the exciting of the slotline 16. The excited slotline 16 may radiate electromagnetic energy bidirectionally over a relatively broad frequency band.

The antenna, according to this embodiment of the present invention, is geometrically smaller than another antenna performing the same functions, but without such features as the slow-wave structure of the slotline 16 and the replication of a pattern of the slotline shape by a conductive layer strip 18.

According to one non-limiting example, the feedpoint 23 is arranged at the center of an aperture of the antenna. The center may include a bridge 24 connecting the two arms of the slotted spiral, and the feedpoint 23 is arranged at the bridge 24.

In order to accomplish maximum energy transfer in broadband operation, the conductive layer strip 18 at the feedpoint 23 is configured to have an impedance substantially equal to one-half of the impedance of the slotline. To achieve this impedance match, a width of the conductive layer strip 18 and/or the spiral slotline 16 can be adjusted to given values.

After the feedpoint 23, the conductive layer strip 18 continues and winds back out from the feedpoint 23. It can extend any multiple of a desired quarter wavelength at a desired frequency. Alternatively, it may continue to wind out to the end 27 of the conductive layer strip 18, where it may be resistively terminated. Still, alternatively, other reactive or lossy termination may be implemented by utilizing a high dielectric loss material, tapered absorbing material, resistive layer, resistor cards, resistive paint, lumped element or any combination of materials and methods performing the reactive or lossy termination functions.

To prevent wave reflection from ends 25 of the slotline 16, the outer ends of the slotline spiral may be configured for matching an impedance of the slotline to the impedance of a space surrounding the spiral curve. According to one non-limiting example, in order to accomplish the matching, the slot width is modified. According to another non-limiting example, the ends are loaded with electromagnetic absorbing element, as shown in FIG. 2, such as a dielectric loss material 28. Tapering of the material 28 thickness, as shown in FIG. 2, can improve its effectiveness by making a change in the volume of the terminating material to be more gradual. Alternatively, the outer slot arms may be terminated by using deposition various lossy materials, resistive layers, resistive points, resistor cards, other similar materials, lumped element or any combination of materials and methods performing the reactive or lossy termination functions.

Figure 3:
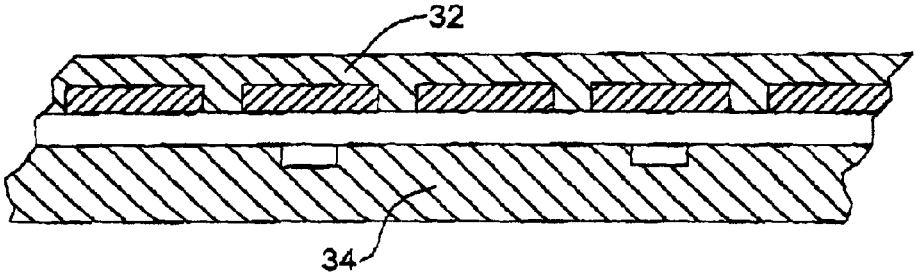
FIG. 3 is a schematic view of a cross-section of a portion of the antenna according to another embodiment of the present invention.

In order to enhance the performance of the antenna, superstrate layers 32 and 34 are placed on the first and/or second side, as shown in FIG. 3. Preferably, but not necessarily, the material of superstrate layers 32 and 34 has high permittivity and low dielectric loss values. The selection of such material may extend the operation frequency of the antenna in the low limit of the frequency band, without a noticeable deterioration in the antenna's performance.

The antenna 10 may be fed using any conventional manner, and in a manner compatible with the corresponding external electronic unit (source or receiver) for which the antenna is employed. For example, the external unit may be connected to the balun 17 by attaching a connector (not shown) at the end (26 in FIG. 1) of the conductive layer strip 18, and fastening a coax cable or any other transmission line (not shown) between this connection and the external unit.

Figure 4A:
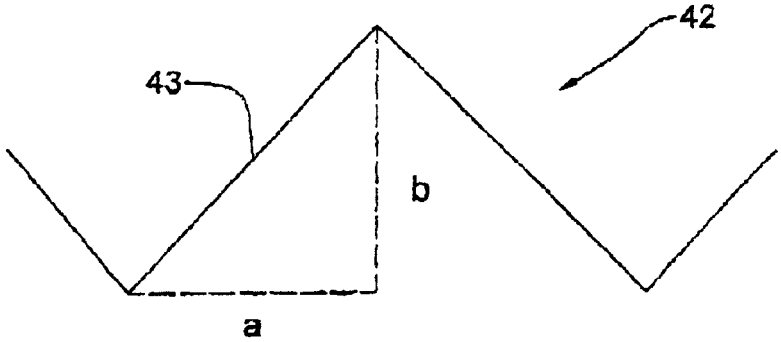
FIG. 4*a* is a schematic view of a conventional zigzag.
Figure 4B:
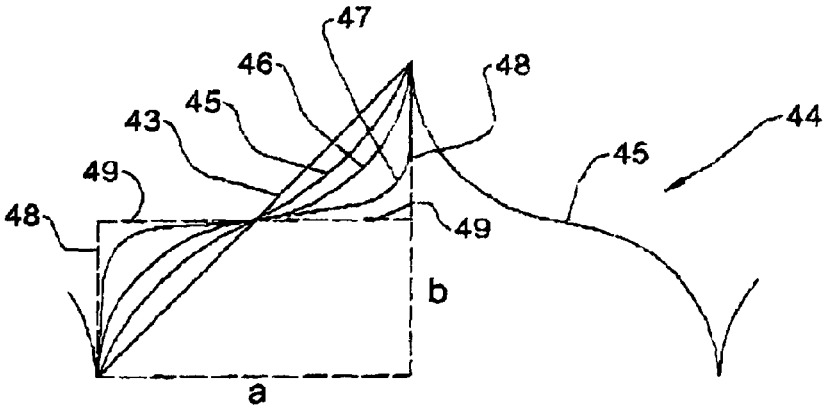
FIG. 4*b* is a schematic view of a modified zigzag, according to one embodiment of the present invention.

Turning to FIG. 4*a* and FIG. 4*b*, a conventional zigzag 42 and a modified zigzag 44 are shown, according to one embodiment of the present invention. The conventional zigzag 42 has straight-line teeth 43, while the modified zigzag 44 has a reversed S-type shape 45. Using various configurations, e.g., the configurations 45 through 47 of the modified zigzag, it is possible to further increase the length of the slotline (16 in FIG. 1), when compared with using the length 43 of the conventional zigzag 42. As a consequence of the increase in the zigzag length, the slow-wave factor of the configuration decreases, and the low frequency limit of the antennas' operation is extended without changes of the overall antenna geometry in the position and number of the zigzag's teeth.

A slow wave factor $F_{con}$ of the conventional zigzag 42 as compared to a straight-line slotline (i.e. a slotline without any zigzag) may be obtained by $$F_{con} = \frac{a}{\sqrt{a^2 + b^2}} \tag{1}$$

wherein the parameters a and b are shown in FIG. 4*a*.

An upper limit value of the length of a side of the zigzag's tooth is a+b. This limit may be achieved by approaching dotted lines 48 and 49 by the consequent consideration of the modified zigzags 45, 46, 47, etc. A slow wave factor $F_{lim}$ of the limiting zigzag as compared with the conventional zigzag may be obtained by $$F_{lim} = \frac{\sqrt{a^2 + b^2}}{a + b} \tag{2}$$

wherein the parameters a and b are shown in FIG. 4*b*.

An overall improvement of the slow-wave factor of the limiting modified zigzag as compared with straight-line slotline may be obtained by $$F_{ov} = F_{con} F_{lim} = \frac{a}{a + b} \tag{3}$$

The values of slow-wave factors for the conventional zigzags (calculated by using Eq. (1)) and the corresponding values for the limiting modified zigzags having various configurations (calculated by using Eq. (3)) are shown in the Table in FIG. 5. The zigzags are characterized by a slop of the teeth. Each row in the Table corresponds to the same value of the slop. As it can be seen from the table, the value of the slow-wave factor for a modified zigzag is always less than the value for a corresponding conventional zigzag. Thus the modified zigzag may increase the operating band of the antenna (better than on 20%) with respect to the low frequency limit of an antenna with a conventional zigzag without changes of the overall antenna geometry in the position and number of the zigzag's teeth.

Figure 6:
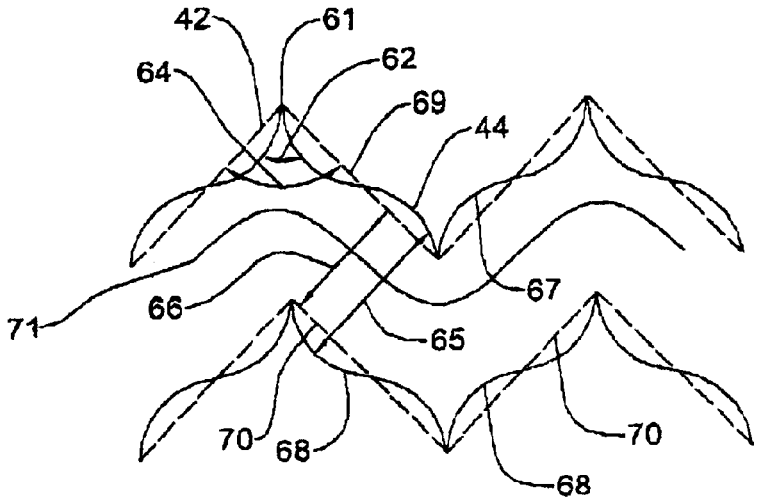
FIG. 6 is a schematic view of a modified zigzag illustrating the differences between the modified zigzag and the conventional zigzag.

As it may be seen in FIG. 6, in vertexes 61 of the zigzags, angles 62 of the teeth of the modified zigzag 44 always have less magnitude than angles 64 of the conventional zigzag 42. In the limit, the modified zigzag may have an angle of the teeth of about zero that may also improve the radiation of the antenna.

It may be appreciated by a person versed in the art that when the slotline (16 in FIG. 1) has the shape of modified zigzag 44, it provides many additional advantages, when compared with the shape of conventional zigzag 42. For instance, the increase of the slow-wave factor for the modified zigzags results in the widening of the antenna's frequency band. Additionally, the distance 65 (for the modified zigzag 44) between two neighboring parts 67 and 68 of the slotline is larger than the distance 66 (for the modified zigzag 44) between two neighboring parts 69 and 70, resulting in less influence of the slotline on the balun 71. Yet, additionally, a decrease in the magnitude of the teeth angle results in better radiation performance of the slotline.

Figure 7A:
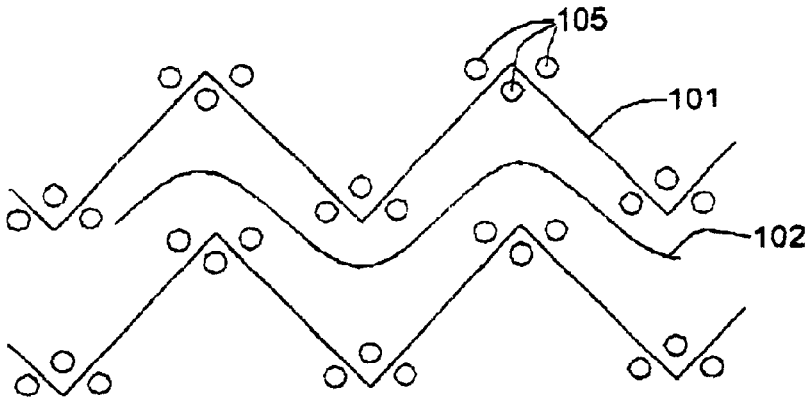
FIG. 7*a* is a schematic view of a conventional zigzag with vias, according to one embodiment of the present invention.
Figure 7B:
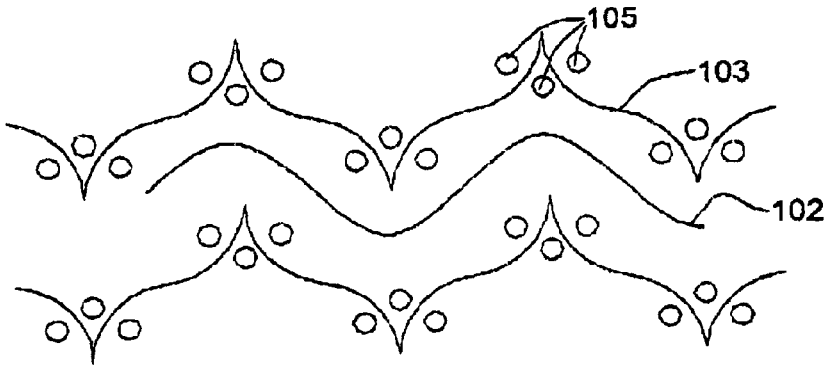
FIG. 7*b* is a schematic view of a modified zigzag with vias, according to another embodiment of the present invention.

Referring now to FIG. 7*a* and FIG. 7*b*, two embodiments of the present invention are illustrated implemented for minimizing a coupling between a conventional zigzag slotline (101 in FIG. 7*a*) and a conductive layer strip 102, and a modified zigzag slotline (103 in FIG. 7*a*) and a conductive layer strip 102, respectively.

According to these embodiments, vias 105 are arranged in the vicinity of zigzag vertexes. For example, the vias 105 may be in the form of a set of empty bores having a conductive cover on the internal surface of the bores. According to another example, the bores may be filled with a conductive material, e.g. with metal pins. Preferably, but not mandatory, that a triple via arrangement (as shown in FIG. 7*a* and FIG. 7*b*) is made around each tooth of the zigzags.

Figure 8A:
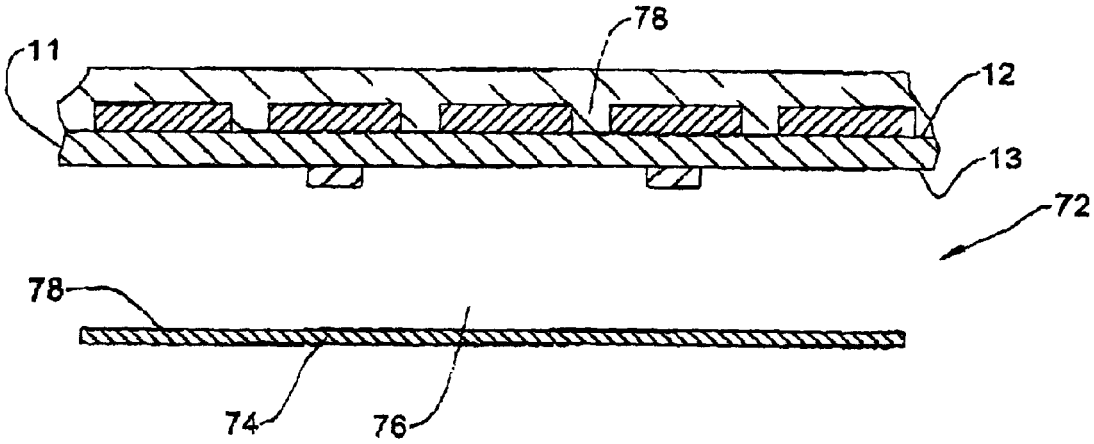
FIG. 8*a* is a schematic view of a cross-section of a portion of the antenna including a cavity, according to one embodiment of the present invention.
Figure 8B:
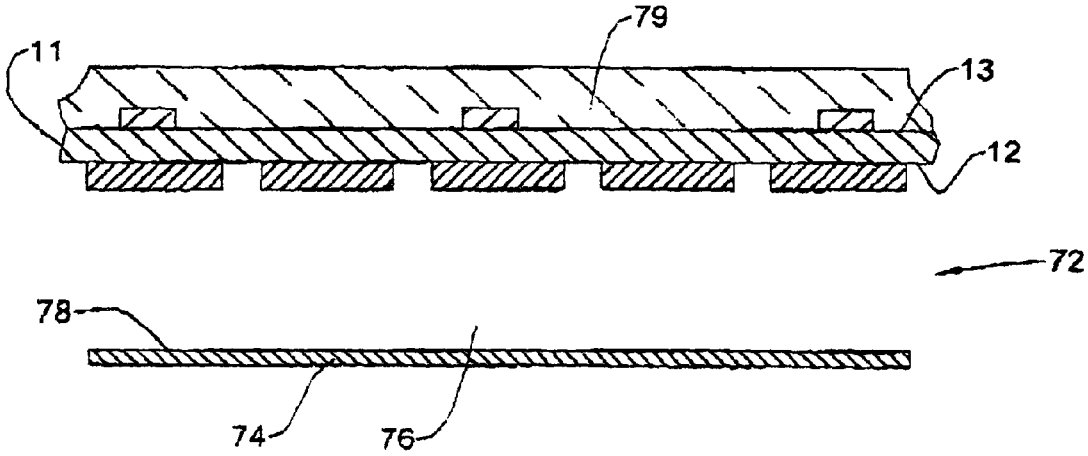
FIG. 8*b* is a schematic view of a cross-section of a portion of the antenna including a cavity, according to another embodiment of the present invention.

Referring now to FIG. 8*a* and FIG. 8*b*, two embodiments of the present invention are illustrated, in which the antenna 10 further includes a cavity 72 that is configured to limit the radiation of the antenna to one direction. The cavity 72 may face either the send surface 13 (as illustrated in FIG. 8*a*) or the first surface 12 (as illustrated in FIG. 8*b*).

The cavity 72 may have an absorbing or reflective bottom 74 and walls (not shown in FIGS. 8*a* and 8*b*). The bottom 74 may be planar, conical or may be shaped in another manner. Magnetic currents running along the spiral slot 15 provide a bi-directional radiation of the slot antenna 10. When the bottom 74 is absorbing bottom, the wave radiated into the cavity 72 will be absorbed and the antenna's radiation will be limited to one direction.

On the other hand, when the bottom 74 is reflective, the wave radiated into the cavity 72 may be reflected by a backing surface 78 that operates as a ground plane. Thus, the antenna including the cavity 72 with the reflective bottom 74, may have an enhanced gain, when compared with the gain of the antenna without the reflective bottom.

Since the slot 15 may be considered as a shunt element, the cavity 72 may be a very thin cavity (lesser than a 1/10th of a wavelength) maintaining the antenna broadband performance and reflecting the wave by backing surface 78 approximately in phase with the corresponding outward radiating wave. This is an important characteristic of the design, because it enables the antenna as a whole to be very thin. Thus, the thin antenna of this embodiment of the present invention may be mounted flush with the surface of the mounting platform (e.g., a communicating device) or may be inset in the outer skin of the mounting platform.

According to one embodiment of the present invention, the cavity 72 is empty. According to another embodiment of the present invention, the cavity 72 is filled with a material 76. It may include any combination and number of layers of material fillings. In particular, the filling of the cavity with a dielectric material may serve to shift the antenna operation to lower frequencies and this is equivalent to reducing the aperture dimension.

According to one embodiment, the material 76 may be a high dielectric loss material. This configuration may be utilized in conjunction with absorbing bottom 74. According to another embodiment, when the bottom 74 is reflective, the material 76 may be a low dielectric loss material.

It should be appreciated that the antenna 10 with the cavity 72 may further include superstrate layers 78 and 79. The superstrate layers 78 may be placed on the first side 12 of the substrate 11 (as shown in FIG. 8*a*) or on the second side 13, (as shown in FIG. 8*b*). Preferably, but not mandatory, the material of superstrate layers 78 and 79 has high permittivity and low dielectric loss values. The selection of such material may further extend the operation frequency of the antenna in the low limit of the frequency band, without noticeable deterioration of the antenna's performance. However, it should be appreciated that a number of various materials and material compositions may be used upon the antenna's design and requirements.

It should be further appreciated that the antenna 10 with the cavity 72 may further include a vias arrangement as described above with reference to FIG. 7*a* and FIG. 7*b*.

Figure 9:
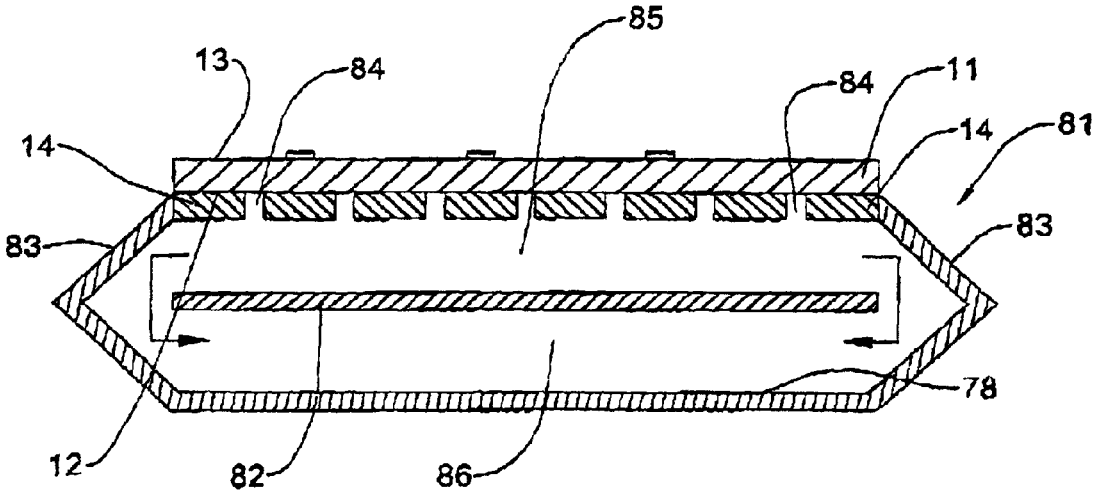
FIG. 9 is a schematic view of a cross-section of a portion of the antenna including a cavity having a second ground plane, according to one embodiment of the present invention.

Further embodiment of the present invention is shown in FIG. 9, a modified cavity 81 is shown that further includes a second ground plane 82. The second ground plane 82 is in the form of a conductive plate mounted between the dielectric substrate 11 and the cavity backing surface 78. The second ground plane 82 divides the cavity 81 into sections 85 and 86. The modified cavity 81 further includes re-radiating cavity edges 83 attached to the conductive layer 14. The second ground plane 82 and re-radiating cavity edges 83 are provided for redirecting a wave radiated from ends 84 of the slotline (16 in FIG. 1) to the section 86 (between the second ground plane 82 and said cavity backing surface 78). Preferably, but not mandatory, the section 86 is filled with a high dielectric loss material. In particular, the described above configuration of the modified cavity 81 may provide an extension of termination of the slotline's ends 84 to the section 86 for providing an enhanced impedance match.

It should be appreciated that the modified cavity 81 may face either the first surface 12 (as in FIG. 9) or the second surface 13 (the figure is not shown).

According to yet further embodiment of the present invention, the second ground plane 82 may have regions through which a full or partial transmission of electromagnetic field is enabled, for example, by providing a plurality of bores in the second ground plane 82. This feature is provided for a possibility to combine a main radiation emitted from the slotline (16 in FIG. 1) together with the radiation emitted from the slotline's ends 84, and thereby provide a further enhanced impedance match and overall antenna performance.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

It is apparent that the antenna of the present invention is not bound to the examples of the symmetric and planar antennas. If necessary, the form and shape of the antenna may be defined by the form and shape of the mounting platform.

It can be appreciated by a man of the art that the slot spiral miniaturized antenna of the present invention may have numerous applications. The list of applications includes, but is not limited to, various portable devices operating in the frequency band of about 800 MHz to 3 GHz. In particular, the antenna of the present invention would be operative with various hand-held mobile communication devices, e.g., mobile phones, PDAs. remote control units, etc. The term "hand-held" means that the communication device is small in size and comparable with the size of a palm. It should be appreciated that this term includes also ear-piece and head-mounted devices.

Employment of the antenna of the present invention for operating a mobile phone may eliminate one of the drawbacks pertinent to most conventional mobile phones, i.e., the omnidirectional transmission of electromagnetic radiation from such apparatuses. When using a mobile phone, the user holds the mobile phone in close proximity to the biological tissue of the user's head. The phone transmits microwave electromagnetic radiation in all directions, therefore part of the energy is absorbed by the head tissues. It is believed in certain communities that the radiation absorbed by the head may cause cancer or create other health risks or hazards to the user talking over such devices. In addition, the energy absorbed by the head reduces the strength of the radiation signal emitted from the conventional antenna for communication and decreases the efficiency of the mobile phone.

Figure 10:
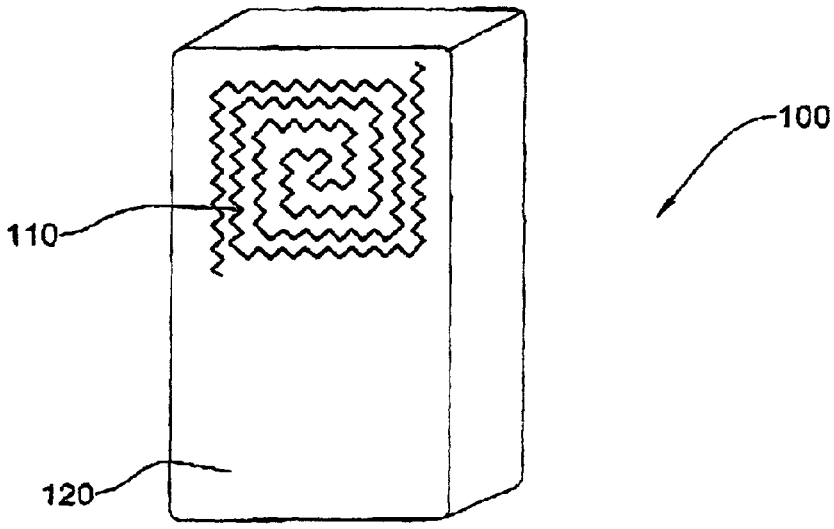
FIG. 10 is a schematic view of a mobile communication device including an antenna of the present invention.

FIG. 10 schematically illustrates an antenna 110 of the present invention mounted on a back surface 120 of a mobile communication device 100. When the antenna 110 includes a backed cavity (not shown), it radiates uni-directionally. Such implementation of the antenna eliminates the aforementioned drawback of conventional antennas, since the radiation directed towards the user (not shown) will be significantly decreased, when compared with the bi-directional radiation of the conventional communication devices.

Additionally, the antenna of the present invention may allow reducing the development effort required for connectivity between different communication devices associated with different communication services and operating in various frequency bands. Typically, the modern communication devices operate in different non-overlapping frequency bands distributed over a wide frequency range of about 800 MHz to 3 GHz. The antennas utilized in these devices are typically constructed for operation with a specific frequency band, reserved by a specific communication service. For example, the frequency band utilized by APMS (Advanced Mobile Phone Service) is 824 MHz–894 MHz, while the band utilized by PCS (Personal Communication Service) is 1850 MHz–1990 MHz. Therefore, if a user wants to change the communication service, he has to change the communication device, that may be inconvenient for the user.

The antenna of the present invention may be utilized for operating over a wide frequency range of about 800 MHz to 3 GHz that may cover many applications by using only a single communication device. Accordingly, the antenna of the present invention may allow utilizing a single cellular phone for communicating over different cellular services.

According to one non-limiting example, the antenna of the present invention may be automatically configured to provide mutual operation of at least three communication services.

According to another non-limiting example, the antenna of the present invention may be automatically configured to operate over at least one octave frequency band within the frequency range of about 800 MHz to 3 GHz.

The antenna of the present invention may be utilized in Internet phones, Bluetooth applications, tag systems, remote control units, video wireless phone, communications between Internet and cellular phones, etc.

The antenna may also be utilized in various intersystems, e.g., in communication within the computer wireless LAN (Local Area Network), PCN (Personal Communication Network) and ISM (Industrial, Scientific, Medical Network) systems.

The antenna may also be utilized in communications between the LAN and cellular phone network, GPS (Global Positioning System) or GSM (Global System for Mobile communication).

Figure 11:
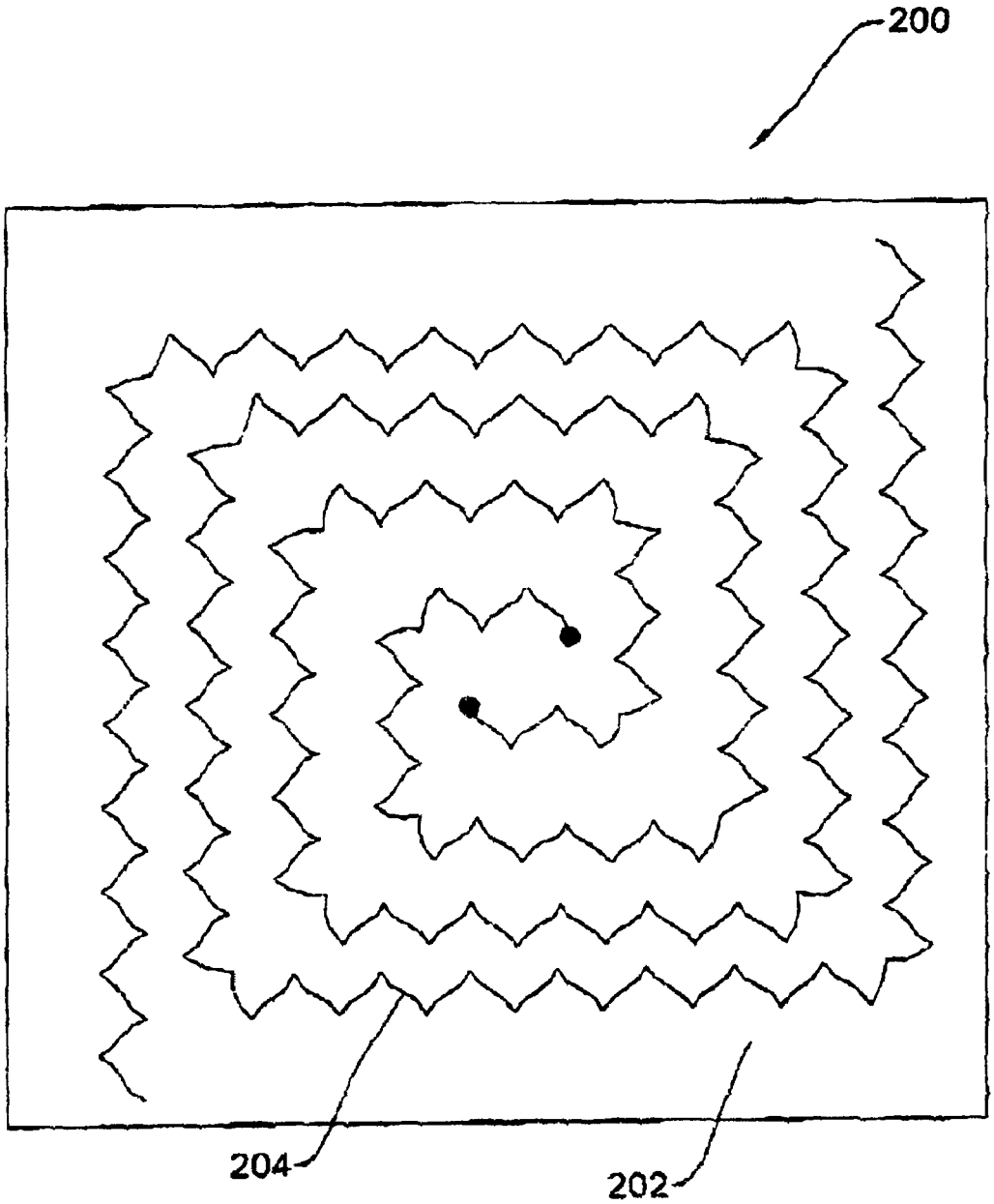
FIG. 11 is a schematic view of a spiral antenna having a modified zigzag implemented on a conductive layer exciting element, according to another general aspect of the present invention.

Referring now to FIG. 11 that schematically illustrates a spiral conductive layer antenna 200 according to another general aspect of the invention. The antenna 200 includes a dielectric substrate 202 on which a microstrip spiral 204 having a pattern of a reversed S-type zigzag (44 in FIG. 4*b*) is fabricated by any conventional printed circuit technique.

It should be appreciated that the spiral may be in any form, e.g., rectangular, Archimedean, logarithmic, acentric, non-symmetric form and a combination thereof.

According to one non-limiting example, the spiral has a two-arm configuration (as shown in FIG. 11).

According to another non-limiting example, the spiral has a multi-arm configuration (not shown).

The antenna 200 may further include a backed cavity (not shown in FIG. 11) arranged in any conventional manner, e.g., as described in the paper titled: "Reduced size spiral antenna", Proc. 9-th European Microwave Conf., September. 1979, pages 181–185, by Morgan (incorporated herein by reference).

The antenna 200 may be fed by a source in any conventional manner. therefore, it will not be expounded hereinbelow.

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims.

What is claimed is:

1. A slot spiral antenna comprising:

(a) a dielectric substrate of a predetermined form having a first surface and a second surface, (b) a conductive layer on said first side of the substrate, said conductive layer including at least one slot defined by a slotline arranged in the form of a spiral curve, at least a portion of the slotline having a pattern corresponding to a slow-wave structure;

(c) a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact.

2. The antenna of claim 1 wherein at least a part of said slow-wave structure is selected from a group including zigzag, meander line, sine and fractal.

3. The antenna of claim 2 wherein said zigzag is a modified zigzag.

4. The antenna of claim 3 wherein teeth of the zigzag in vertexes have an angle of about zero degree.

5. The antenna of claim 1 wherein said conductive layer strip has a sine wave configuration.

6. The antenna of claim 1 wherein said spiral curve being a slotted two arm spiral configured to radiate bidirectionally electromagnetic energy over a broad frequency band.

7. The antenna of claim 6 wherein said feedpoint being arranged at a bridge connecting the two arms of the slotted spiral.

8. The antenna of claim 1 wherein at least a portion of said spiral curve is selected from a group including rectangular, Archimedean, logarithmic, acentric and non-symmetric form.

9. The antenna of claim 1 wherein the feedpoint being arranged at a center of an aperture of said antenna.

10. The antenna of claim 1 wherein the feedpoint being arranged at any place of an aperture of said antenna.

11. The antenna of claim 1 wherein the slotline having ends being terminated by an element preventing wave reflection.

12. The antenna of claim 11 wherein said element is selected from the group that includes a lossy material, tapered absorbing material, resistive layer, resistor cards, resistive paint and lumped element.

13. The antenna of claim 1 wherein the slotline having slotline ends, the slotline at the ends being configured for matching an impedance of the slotline to the impedance of a space surrounding the spiral curve.

14. The antenna of claim 1 further comprising a connector for connecting the balun to a source.

15. The antenna of claim 14 wherein an impedance of said conductive layer strip being matched to the impedance of the connector.

16. The antenna of claim 1 wherein said conductive layer strip continues after the feedpoint for providing wideband matching.

17. The antenna of claim 16 wherein said conductive layer strip continues after the feedpoint a distance equal to a multiple of one quarter wavelength of a desired frequency.

18. The antenna of claim 16 wherein said conductive layer strip is terminated after the feedpoint by an element preventing wave reflection, said element is selected from the group consisting of a high dielectric loss material, tapered absorbing material, resistive layer, resistor cards, resistive paint and lumped element.

19. The antenna of claim 1 wherein said conductive layer acts as a ground plane for said conductive layer strip.

20. The antenna of claim 1 further comprising a superstrate layer placed on the first and second sides of said dielectric substrate.

21. The antenna of claim 20 wherein said superstrate layer being a high permittivity and low dielectric loss material.

22. The antenna of claim 1 wherein a width of said conductive layer strip being at least three times less than the width of said section on the conductive layer defined by the area between two neighboring parts of the slotline.

23. The antenna of claim 1 further comprising a thin reflecting cavity facing said first side of the substrate, the cavity having a bottom, the bottom having a cavity backing surface configured to reflect the radiation emitted by said slotline so as to render said antenna unidirectional.

24. The antenna of claim 1 further comprising a thin reflecting cavity facing said second side of the substrate, the cavity having a bottom, the bottom having a cavity backing surface configured to reflect the radiation emitted by said slotline so as to render said antenna unidirectional.

25. The antenna of claim 23 wherein the cavity being filled with a high dielectric loss material.

26. The antenna of claim 23 wherein the cavity being filled with a low dielectric loss material.

27. The antenna of claim 24 wherein the cavity being filled with a high dielectric loss material.

28. The antenna of claim 24 wherein the cavity being filled with a low dielectric loss material.

29. The antenna of claim 23 wherein the cavity being filled with a multi-layer dielectric having different permittivity and dielectric losses for each layer.

30. The antenna of claim 24 wherein the cavity being filled with a multi-layer dielectric having different permittivity and dielectric losses for each layer.

31. The antenna of claim 1 further comprising a thin absorptive cavity facing said first side of the substrate, the cavity having a bottom, the bottom having a cavity backing surface configured to absorb the radiation emitted by said slotline so as to render said antenna unidirectional.

32. The antenna of claim 1 further comprising a thin absorptive cavity facing said second side of the substrate, the cavity having a bottom, the bottom having a cavity backing surface configured to absorb the radiation emitted by said slotline so as to render said antenna unidirectional.

33. The antenna of claim 26 further comprising a superstrate layer placed on said second side of said substrate, said superstrate layer having a dielectric loss higher than the dielectric loss of said low dielectric loss material.

34. The antenna of claim 28 further comprising a superstrate layer placed on said first side of said substrate, said superstrate layer having a dielectric loss higher than the dielectric loss of said low dielectric loss material.

35. The antenna of claim 1 wherein at least a part of said slow-wave structure having a zigzag shape, said antenna further comprising vias configured for minimizing a coupling between the slotline and said conductive layer strip.

36. The antenna of claim 35 wherein a plurality of teeth of said zigzag shape having an angle of about zero.

37. The antenna of claim 35 wherein a triple via arrangement being made around each tooth.

38. The antenna of claim 36 wherein a triple via arrangement being made around each tooth.

39. The antenna of claim 23 wherein said cavity backing surface being non-planar in shape.

40. The antenna of claim 24 wherein said cavity backing surface being non-planar in shape.

41. The antenna of claim 23 wherein said cavity backing surface acts as a ground plane.

42. The antenna of claim 24 wherein said cavity backing surface acts as a ground plane.

43. The antenna of claim 41 further comprising:

(a) a second ground plane in the form of a conductive plate mounted between said dielectric substrate and said cavity backing surface;

(b) re-radiating cavity edges attached to said conductive layer, said second ground plane and re-radiating cavity edges being provided for redirecting a wave radiated from ends of the slotline to a section between said second ground plane and said cavity backing surface, said section being filled with a high dielectric loss material, thereby a termination of the slotline's ends being extended to said section for providing an enhanced impedance match and reducing an aperture dimension of said antenna.

44. The antenna of claim 42 further comprising:

(a) a second ground plane in the form of a conductive plate mounted between said dielectric substrate and said cavity backing surface, (b) re-radiating cavity edges attached to said conductive layer, said second ground plane and re-radiating cavity edges being provided for redirecting a wave radiated from ends of the slotline to a section between said second ground plane and said cavity backing surface, said section being filled with a high dielectric loss material, thereby a termination of the slotline's ends being extended to said section for providing an enhanced impedance match and reducing an aperture dimension of said antenna.

45. The antenna of claim 43 wherein said second ground plane having regions through which a full or partial transmission of electromagnetic field is enabled for combining a main radiation emitted from the slotline with the radiation emitted from the slotline's ends, thereby providing a further enhanced impedance match.

46. The antenna of claim 44 wherein said second ground plane having regions through which a full or partial transmission of electromagnetic field is enabled for combining a main radiation emitted from the slotline with the radiation emitted from the slotline's ends, thereby providing a further enhanced impedance match.

47. The antenna of claim 1 being conformed to complexly shaped surfaces and contours of a mounting platform.

48. The antenna of claim 47 wherein a mounting platform being a body of a hand-held communication device.

49. A slot spiral antenna comprising:

(a) a dielectric substrate of a predetermined form having a first surface and a second surface, (b) a conductive layer on said first side of the substrate, said conductive layer including at least one slot defined by a slotline arranged in the form of a spiral curve, at least a portion of the slotline having a pattern corresponding to a slow-wave structure;

(c) a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact, wherein said antenna being fitted for use in a hand-held communication device.

50. The antenna of claim 48 wherein the mobile communication device being selected from the group including mobile phone, PDA and remote control units.

51. A slot spiral antenna comprising:

(a) a dielectric substrate of a predetermined form having a first surface and a second surface, (b) a conductive layer on said first side of the substrate, said conductive layer including at least one slot defined by a slotline arranged in the form of a spiral curve, at least a portion of the slotline having a pattern corresponding to a slow-wave structure;

(c) a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact, wherein said antenna being automatically configured to operate over at least one octave frequency band within the frequency range of about 800 MHz to 3 GHz.

52. A hand-held communication device comprising an antenna comprising:

(a) a dielectric substrate of a predetermined form having a first surface and a second surface, (b) a conductive layer on said first side of the substrate, said conductive layer including at least one slot defined by a slotline arranged in the form of a spiral curve, at least a portion of the slotline having a pattern corresponding to a slow-wave structure;

(c) a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact.

53. The hand-held communication device of claim 52 being selected from the group that includes mobile phone, PDA and remote control units.

54. The hand-held communication device of claim 52 wherein said antenna being automatically configured to operate over at least one octave frequency band within the frequency range of about 800 MHz to 3 GHz.

55. A method of fabricating a slot spiral antenna comprising:

(a) providing a dielectric substrate of a predetermined form having a first surface and a second surface;

(b) forming a conductive layer on said first side of the substrate, said conductive layer including at least one slot defined by a slotline arranged in the form of a spiral curve, at least a portion of the slotline having a pattern corresponding to a slow-wave structure;

(c) forming a planar balun on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact.

56. The method of claim 55 wherein at least a part of said slow-wave structure is selected from a group including zigzag, meander line, sine and fractal.

57. The method of claim 56 wherein said zigzag is a modified zigzag.

58. The method of claim 55 wherein said conductive layer strip has a sine wave configuration.

59. The method of claim 55 wherein said feedpoint being arranged at a bridge connecting the two arms of the slotted spiral.

60. The method of claim 55 wherein at least a portion of said spiral curve is selected from a group including rectangular, Archimedean, logarithmic, acentric and non-symmetric form.

61. The method of claim 55 wherein the slotline having ends being terminated by an element preventing wave reflection.

62. The method of claim 55 wherein said conductive layer strip continues after the feedpoint for providing wideband matching.

63. The method of claim 55 further comprising the step of placing a superstrate layer on the first and second sides of said dielectric substrate.

64. The method of claim 55 further comprising the step of providing a thin reflecting cavity facing said first side of the substrate, the cavity having a bottom, the bottom having a cavity backing surface configured to reflect the radiation emitted by said slotline so as to render said antenna unidirectional.

65. The method of claim 55 further comprising the step of providing a thin reflecting cavity facing said second side of the substrate, the cavity having a bottom, the bottom having a cavity backing surface configured to reflect the radiation emitted by said slotline so as to render said antenna unidirectional.

66. The method of claim 55 further comprising the step of providing a thin absorptive cavity facing said first side of the substrate, the cavity having a bottom, the bottom having a cavity backing surface configured to absorb the radiation emitted by said slotline so as to render said antenna unidirectional.

67. The method of claim 55 further comprising the step of providing a thin absorptive cavity facing said second side of the substrate, the cavity having a bottom, the bottom having a cavity backing surface configured to absorb the radiation emitted by said slotline so as to render said antenna unidirectional.

68. The method of claim 55 wherein at least a part of said slow-wave structure having a zigzag shape, said antenna further comprising vias configured for minimizing a coupling between the slotline and said conductive layer strip.

69. A slot spiral antenna comprising:

(a) a dielectric substrate of a predetermined form having a first surface and a second surface, (b) a conductive layer on said first side of the substrate, said conductive layer including at least one slot defined by a slotline arranged in the form of a spiral curve, at least a portion of the slotline having a pattern corresponding to a slow-wave structure;

(c) a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact, thereby said antenna is geometrically smaller than another antenna performing the same functions as said antenna, but without said slow-wave structure of the pattern of said at least a portion of the slotline and without said shape of said conductive layer.

70. A slot spiral antenna comprising:

(a) a dielectric substrate of a predetermined form having a first surface and a second surface, (b) a conductive layer on said first side of the substrate, said conductive layer including at least one slot defined by a slotline arranged in the form of a spiral curve, at least a portion of the slotline having a pattern corresponding to a slow-wave structure;

(c) a planar balun formed on said second side of the substrate, the balun being a conductive layer strip positioned beneath a section on the conductive layer defined by an area between two neighboring parts of the slotline, each neighboring part having a pattern; said conductive layer strip having a shape substantially replicating the pattern of said two neighboring parts of the slotline, said conductive layer strip configured to provide a balanced feed to said at least one slot at a feedpoint defined by a place wherein a projection of said conductive layer strip on said second side intercepts the slotline, thereby exciting the slotline by causing electromagnetic coupling between said conductive layer strip and slotline without electrical contact, wherein said antenna being automatically configured to operate over at least one octave frequency band.

* * * * *